US007733202B2

(12) United States Patent
Feil et al.

(10) Patent No.: US 7,733,202 B2
(45) Date of Patent: Jun. 8, 2010

(54) ELECTROMAGNETIC SWITCHING DEVICE

(75) Inventors: Wolfgang Feil, Schwandorf (DE); Andreas Krätzschmar, Ammerthal (DE); Reinhard Maier, Herzogenaurach (DE); Bernd Trautmann, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 196 days.

(21) Appl. No.: 12/003,141

(22) Filed: Dec. 20, 2007

(65) Prior Publication Data

US 2009/0045893 A1 Feb. 19, 2009

(30) Foreign Application Priority Data

Feb. 23, 2007 (EP) ..... 07003814

(51) Int. Cl.
*H01H 9/00* (2006.01)
*H01F 7/08* (2006.01)

(52) U.S. Cl. ..... 335/179; 335/203; 335/220; 335/229

(58) Field of Classification Search ..... 335/179, 335/203, 205, 220, 229
See application file for complete search history.

(56) References Cited

U.S. PATENT DOCUMENTS 1,606,164 A * 11/1926 Garvin ..... 335/179
2,539,547 A * 1/1951 Mossman et al. ..... 335/153
3,184,563 A * 5/1965 Myatt ..... 335/153
3,274,523 A 9/1966 Bayer
3,281,739 A * 10/1966 Grengg ..... 335/229
4,568,207 A * 2/1986 Hara et al. ..... 400/124.18
4,660,012 A * 4/1987 Bonniau et al. ..... 335/234
4,728,917 A * 3/1988 Kimpel ..... 335/274
5,365,210 A * 11/1994 Hines ..... 335/238
5,959,519 A * 9/1999 Gobel et al. ..... 335/179
2005/0088265 A1 * 4/2005 Nakagawa et al. ..... 335/220

FOREIGN PATENT DOCUMENTS

DE 358530 C 9/1922
DE 196 08 729 7/1997
GB 765256 A 1/1957
JP 03072605 A * 3/1991

* cited by examiner

*Primary Examiner*—Lincoln Donovan
*Assistant Examiner*—Mohamad A Musleh
(74) *Attorney, Agent, or Firm*—Harness, Dickey & Pierce, P.L.C.

(57) ABSTRACT

An electromagnetic switching device is disclosed with an electromagnet and a movable magnet armature, which is mounted in the switching device with a resetting force, which counteracts the closing force, is different than zero in an OPEN position and is formed at least partially by a magnet arrangement with at least one permanent magnet. The magnet arrangement is arranged fixed in position in the switching device outside the magnetic circuit formed from the electromagnet and the magnet armature, and whose resetting force, which acts on the magnet armature, is at a maximum in the OPEN position.

10 Claims, 3 Drawing Sheets

ELECTROMAGNETIC SWITCHING DEVICE

PRIORITY STATEMENT

The present application hereby claims priority under 35 U.S.C. §119 on European patent application number EP 07003814 filed Feb. 23, 2007, the entire contents of which is hereby incorporated herein by reference.

FIELD

Embodiments of the invention generally relate to an electromagnetic switching device with an electromagnet and a movable magnet armature. For example, they may relate to one which is mounted in the switching device with a holding force, which counteracts the closing force and is different than zero in an open position.

BACKGROUND

The principal way in which such an electromagnetic switching device functions is explained with reference to FIGS. 1 to 3 using an example of a contactor. As shown in FIG. 1, such a switching device contains an electromagnet 1 with a magnet yoke 2, on which, for example, two magnet coils 4 for magnetic excitation are arranged. A magnet armature 6 associated with the magnet yoke 2 is mounted in a sprung manner, as a result of a resetting arrangement comprising two resetting springs 8 connected in parallel, in a housing 10 (only illustrated symbolically) of the switching device.

The magnet yoke 2, the magnet coil 4 and the magnet armature 6 form an electromagnetic drive of the switching device. The magnet armature 6 is connected in a force-fitting manner to a movable contact link 14 via a prestressed contact spring 12. Two fixed contact carriers 16 are associated with the movable contact link 14. The magnet armature 6 forms the actuator of the magnetic drive for the relative movement between the contact link 14 and the contact carrier 16.

The contact link 14 and the fixed contact carrier 16 are each provided with contact pieces or contacts 18. The switching contact formed by the movable contact link 14 and the fixed contact carrier 16 is located in the opened position (OPEN position). In this disconnected state, the contacts 18 are located at a distance $s_0$ and the pole faces 20 and 60 of the magnet yoke 2 and the magnet armature 6, respectively, are at a distance of d=H. The resetting springs 8 are prestressed so that the magnet armature 6 is pressed against a stop 22 with a pretensioning or holding force $F_0$ in the rest position of the OPEN position.

When the magnet coils 4 are switched on, the magnet armature 6 is set in motion in the direction toward the magnet yoke 2 counter to the action of the holding force $F=F_0$ exerted by the resetting springs 8, as is illustrated in the figure by the arrows.

FIG. 2 now shows a situation in which touching contact is made between the contacts 18 for the first time, i.e. the magnet armature 6 has covered a travel path $s_0$. At this point in time, the pole faces 20, 60 are at a distance of $d=d_s=H-s_0$. The further closing movement of the magnet armature 6 now continues to take place counter to the increasing spring forces exerted by the resetting springs 8 and in addition counter to the action of the likewise increasing spring force exerted by the contact spring 12 connected in parallel therewith. Since the spring force exerted by the prestressed contact spring 12 is considerably greater than the spring force exerted by the resetting spring 8, the total resetting force acting on the magnet armature 6 increases suddenly.

As things develop, the magnetic force acting on the magnet armature 6 becomes greater than the resetting force exerted by the resetting spring 8 and the contact spring 12, and the magnet armature 6 can move further in the direction toward the magnet yoke 2 until finally, as is illustrated in FIG. 3, it rests with its pole faces 60 on the pole faces 20 of the magnet yoke 2 in an end or rest position (d=0).

The associated force profile is plotted in FIG. 4. In this figure, the resetting force F exerted on the magnet armature 6 by the resetting springs 8 and the contact spring 12 is plotted against the distance d between the pole faces 60, 20 of the magnet armature 6 and the magnet yoke 2. The curve shows that the resetting springs 8 (FIG. 1) exert the holding force $F_0$ in the OPEN position. If current is flowing through the magnet coils 4, the magnet armature 6 is moved under the action of the attraction force exerted by the electromagnet 1 and counter to the action of the resetting springs 8 in the direction toward the pole faces 20 of the magnet yoke 2. With this movement, the resetting force F exerted in the opposite direction on the magnet armature 6 increases linearly with the increasing length contraction of the resetting springs 8, corresponding to the sum of the spring constants of the resetting springs 8. At the distance $d=d_s$, the contacts 18 come into touching contact with one another, and the resetting force F acting on the magnet armature 6 increases suddenly as a result of the prestressed contact spring 12 being connected.

The holding force $F_0$ exerted on the magnet armature 6 in the OPEN position in this position protects the switching device against undesired closing in the event of external mechanical oscillation or impact loading. Over the entire path covered between $d_0$ and $d_s$, the magnet armature 6 therefore always needs to overcome the resetting force F exerted by the resetting springs 8, which resetting force increases successively starting from a finite value (holding force $F_0$) required for mechanically securing the magnet armature 6 in the OPEN position.

In order nevertheless to achieve short switching times (high closing forces), it is therefore necessary to design and dimension the magnet system 2, 4, 6 in such a way that the magnetic force acting on the magnet armature 6 is considerably greater than the resetting force exerted by the resetting springs 8. One disadvantage is the continuous increase in the resetting forces over the entire working range (magnet travel). This results in relatively high, unnecessary forces, which need to be overcome by a magnet drive which is designed to have a correspondingly higher power.

SUMMARY

In at least one embodiment, an electromagnetic switching device with a magnet armature is disclosed, in which the magnet armature on the one hand is securely fixed in an OPEN position with the electromagnet disconnected by high holding forces, and in which, on the other hand, the magnetic force required for accelerating the magnet armature is markedly reduced.

In at least one embodiment, the electromagnetic switching device contains an electromagnet and a movable magnet armature, which is mounted in the switching device with a holding force, which counteracts the closing force, is different than zero in an OPEN position and is formed at least partially by a magnet arrangement with a permanent magnet, which magnet arrangement is arranged fixed in position in the switching device outside of the magnetic circuit formed from the electromagnet and the magnet armature and exerts a resetting force on the magnet armature which is dependent on the location of the magnet armature and is at a maximum in the OPEN position.

Owing to this measure, the resetting spring can either be dispensed with completely or else can be designed without prestress or with a lower spring constant such that it does not have any, or at best only has a low, holding force in the OPEN position. The term "OPEN position" within the context of at least one embodiment of the present invention is generally understood as meaning an operating situation of the switching device in which the electromagnet is deenergized and is not exerting any magnetic force on the magnet armature.

In this case, at least one embodiment of the invention is based on the consideration that the resetting force exerted on a movable magnet armature by a permanent magnet arranged fixed in position in the switching device decreases as the distance between the magnet armature and the permanent magnet increases, so that, on the one hand, high holding forces are achieved in the OPEN position, and, on the other hand, the resetting forces inhibiting the movement of the magnet armature decrease as the distance between the magnet armature and the permanent magnet increases, so that high accelerations of the magnet armature are even achieved in the case of relatively low forces exerted by the magnet drive.

An electromagnetic switching device, in which the holding force exerted on the magnet armature in the OPEN position is assisted by a permanent magnet, is in principle already known from DE 196 08 729 C1. Therein, two plate-shaped permanent magnets are arranged between an inner and outer yoke of an electromagnet. In the OPEN position, the magnet armature bears with its armature plate against the outer yoke. The armature plate, the outer yoke, the permanent magnet, the inner yoke and the plunger core of the magnet armature thus form a closed magnetic circuit. Since the permanent magnet is arranged between the outer and inner yoke of the electromagnet, the known switching device can only be operated with direct current or with pulsed direct current. In addition, under certain circumstances current regulation which limits the electrical holding power is required. Moreover, the magnetic circuit needs to have a two-part yoke.

Since, in contrast to the known switching device, in the switching device in accordance with at least one embodiment of the invention the magnet arrangement is arranged outside of the magnetic circuit formed from the electromagnet and the magnet armature, i.e. does not influence it, the electromagnet can be excited both by direct current and by alternating current. As a result of the increase in the inductance in the closed state, in addition a reduced alternating current is automatically produced.

BRIEF DESCRIPTION OF THE DRAWINGS

In order to further explain embodiments of the invention, reference is made to the drawing, in which.

DETAILED DESCRIPTION OF THE EXAMPLE EMBODIMENTS

Figure 1:
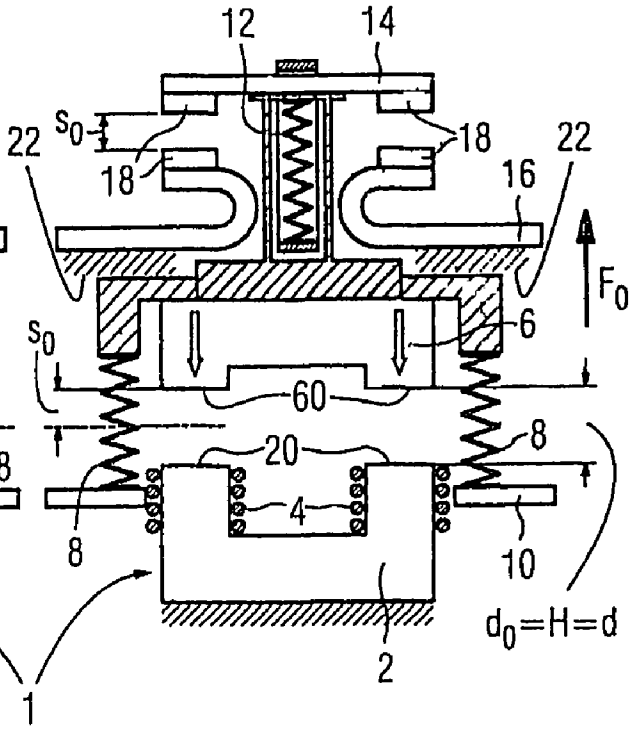
BACKGROUND ART FIG 1
FIGS. 1-3 each show an electromagnetic switching device in accordance with the prior art in a basic illustration at various times in the switch-on operation.
Figure 2:
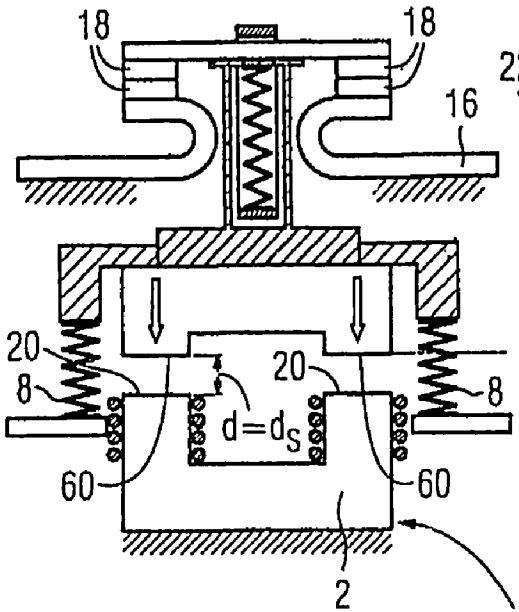
BACKGROUND ART FIG 2
Figure 3:
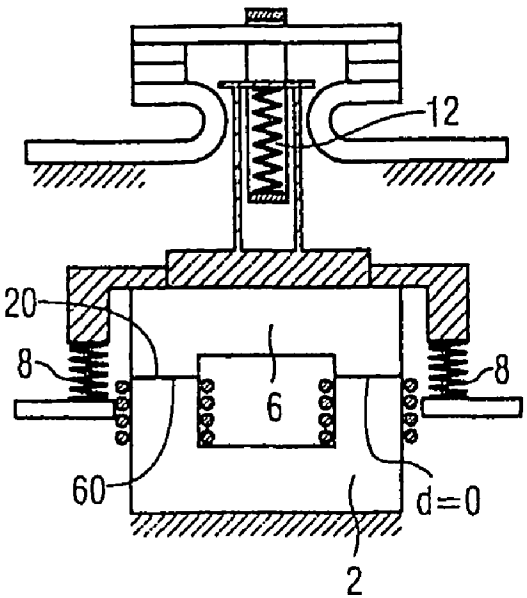
BACKGROUND ART FIG 3

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

Figure 5:
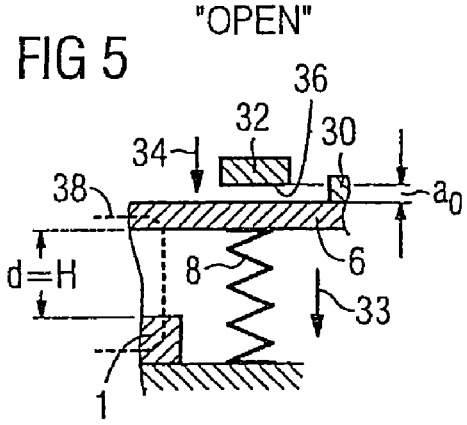

As shown in FIG. 5, the magnet armature 6, which is mounted movably in a switching device and is made from a soft-magnetic material, bears against a symbolically illustrated stop 30 in the OPEN position (d=H), against which stop it is pressed or drawn by the action of a resetting arrangement. The resetting arrangement is formed in the example by resetting springs 8, of which only one is illustrated in the figure (holding force $F_{10}$), and by a magnet arrangement containing at least one permanent magnet 32, which exerts a magnetic force (holding force $F_{20}$) on the magnet armature 6. The permanent magnet 32 is arranged in front of the magnet armature 6, when viewed in the movement direction 33 of the closing movement thereof, and its pole axis 34 runs parallel to the movement direction 33. An air gap $a_0$ is provided between a pole face 36, which faces the magnet armature 6, of the permanent magnet 32 and the rear side (in relation to the movement direction 33 of the closing movement) of the magnet armature 6, which air gap can be used to set the holding and resetting force ($F_{20}$ and $F_2$) exerted by the permanent magnet 32.

The magnet arrangement with the permanent magnet 32 is arranged outside of a magnetic circuit 38, which is formed by the electromagnet 1 and the magnet armature 6 and is illustrated by dashed lines in the figure, so that it does not influence it.

Figure 6:
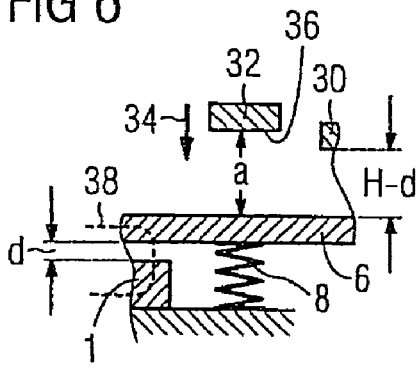

Under the influence of a magnetic or closing force exerted by the electromagnet 1 illustrated merely symbolically in the figure, the magnet armature 6 is now moved counter to the action of the resetting force $F_1$ exerted by the resetting springs 8 and counter to the action of the resetting force $F_2$ exerted by the permanent magnet 32 toward the pole faces of the electromagnet 1, as is illustrated in FIG. 6. As a result of the increase in the distance $a=a_0+H-d$ between the pole face 36 of the permanent magnet 32 and the rear side of the magnet armature 6, the resetting force $F_2$ exerted on said magnet armature by the permanent magnet 32 decreases successively, so that, despite the greater holding force $F_{20}$ exerted by it in the open position shown in FIG. 5, the movement sequence during the closing operation is impeded less and less by the permanent magnet 32.

Figure 4:
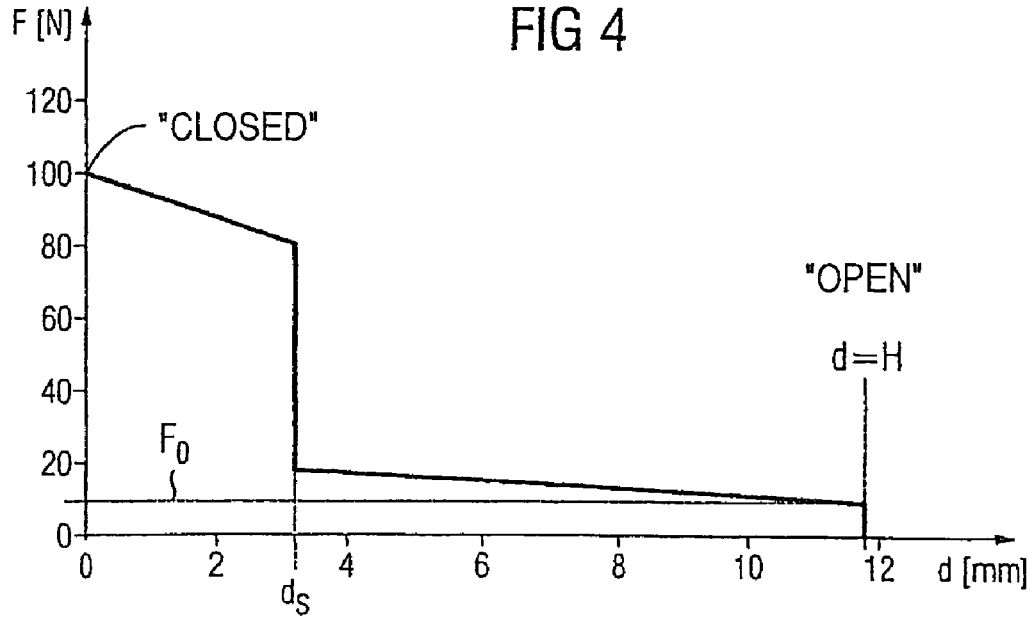
FIG. 4 shows a graph in which the resetting force exerted on the magnet armature of the switching device illustrated in FIGS. 1-3 by the resetting springs and the contact spring is plotted as a function of the distance between the pole faces, FIGS. 5, 6 each show, in a basic illustration, the way in which a permanent magnet, which is arranged in a switching device according to an example embodiment of the invention fixed in position on the rear side of a magnet armature mounted movably in the switching device, functions.
Figure 7:
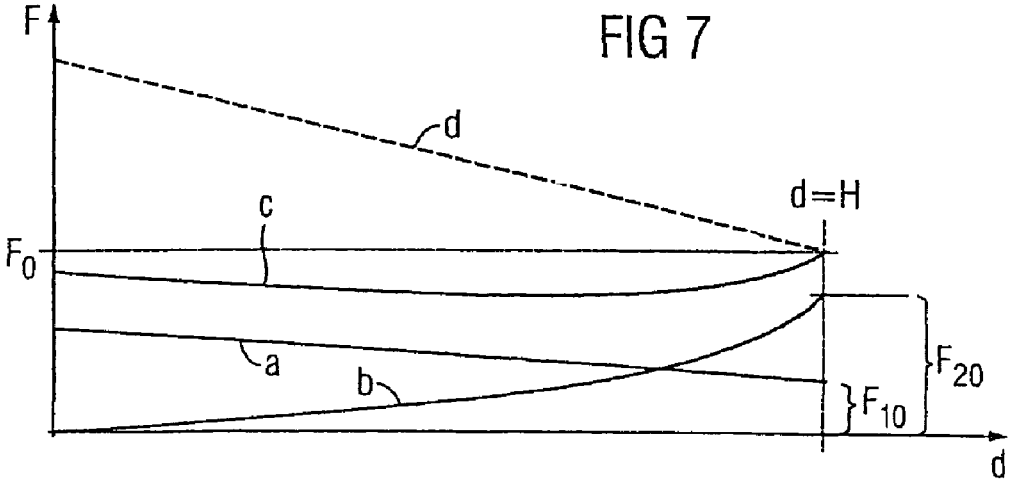
FIG. 7 shows a graph in which the resetting force acting on the magnet armature is plotted against the distance between the pole faces in the example embodiment illustrated in FIGS. 5 and 6, and FIGS. 8, 9 show further example embodiments of a permanent magnet arrangement in accordance with the invention, likewise in each case in a schematic basic illustration.

The profile of the resetting forces $F_1$, $F_2$ and $F=F_1+F_2$ set in this way until the contacts come into touching contact with one another and the contact spring responds is illustrated in FIG. 7. FIG. 7 shows that the holding force $F_0$ resulting at d=H comprises the holding force $F_{10}$ of the resetting spring and the holding force $F_{20}$ of the permanent magnet in the OPEN position. Curve a shows the profile of the resetting force $F_1$ which is exerted by the resetting spring(s) and increases linearly as the distance d decreases similarly to the force profile illustrated in FIG. 4. Curve b illustrates the profile of the resetting force $F_2$ exerted by the permanent magnet on the magnet armature as a function of the distance d of the magnet armature from the magnet yoke of the electromagnet. The figure shows that the resetting force $F_2$ exerted by the permanent magnet in the OPEN position ($F_2=F_{20}$) is at a maximum and decreases continuously in nonlinear fashion as the distance d decreases, i.e. as the distance between the magnet armature and the permanent magnet increases.

The sum F of the resetting forces $F_1$, $F_2$ exerted by the permanent magnet and by the resetting springs is reproduced in curve c. The figure shows that, in this example, the total force $F=F_1+F_2$ exerted by the permanent magnet and the resetting springs is virtually independent of the distance, it also being possible for a different force profile to be achieved by a corresponding design, depending on requirements. In comparison with this, a situation is plotted using dashed lines in curve d as results in the prior art if the resetting force is only produced by prestressed resetting springs, which exert the same holding force $F_0$ in the OPEN position.

In principle, a configuration is also possible in which the resetting arrangement is merely formed by a magnet arrangement with at least one permanent magnet 32, i.e. no resetting spring arrangement with resetting springs 8 is provided.

Figure 8:
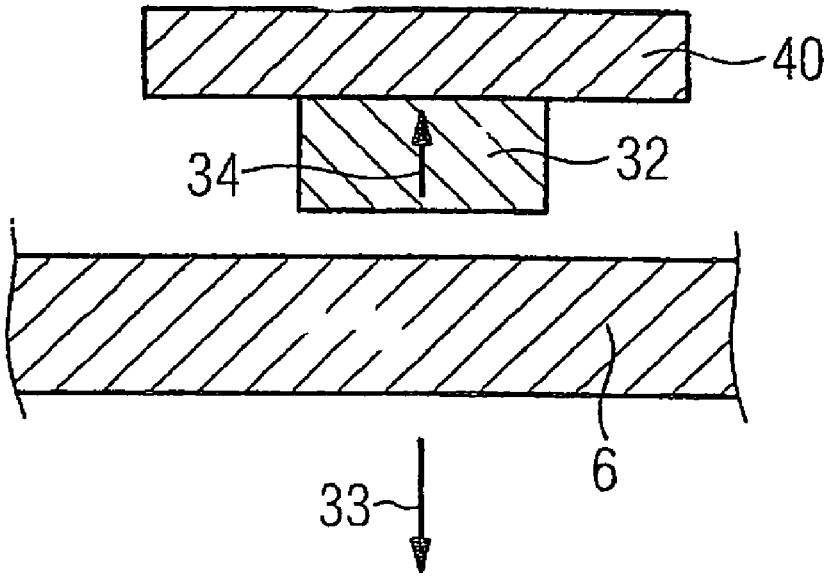

In the magnet arrangement shown in FIG. 8, the permanent magnet 32 can also be provided with an additional baffle 40 on its pole face which faces away from the magnet armature 6. This reduces the clearance of the lines of force and the holding force of the permanent magnet is intensified.

Figure 9:
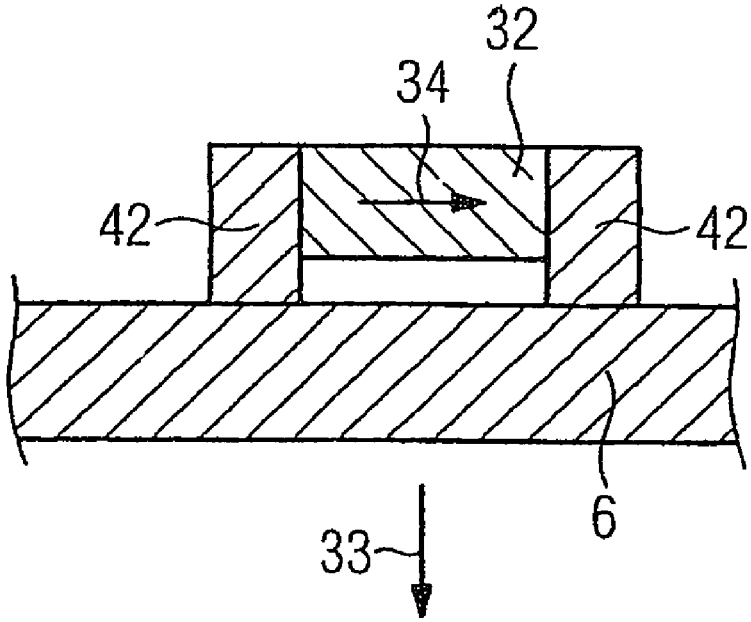

As an alternative to the exemplary embodiment illustrated in FIGS. 5, 6 and 8, in accordance with which the pole axis 34 of the permanent magnet is directed in the direction of the force exerted by it parallel to the movement direction 33 of the closing movement of the magnet armature 6 (if the rear side of the magnet armature 34 is flat, at right angles to this rear side), a magnet arrangement can also be provided in accordance with FIG. 6 in which the pole axis 34 of the permanent magnet 32 is oriented at right angles to this movement direction 33 of the magnet armature 6. In addition, in this embodiment lateral baffles 42 can be arranged on the pole faces of the permanent magnet 32. With the aid of the dimensions of the baffles 42, it is also possible for useful and stray fluxes to be controlled. In addition, a situation is illustrated in FIG. 9 in which the magnet armature 6 bears against the baffles in the open position.

In the example embodiments, compression springs are illustrated as the resetting springs 8. In principle, it is also possible for tension springs to be used for the resetting springs 8 in another arrangement in the switching device.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromagnetic switching device, comprising:

an electromagnet; and a movable magnet armature, mounted in the switching device with a holding force which counteracts a closing force exerted by the electromagnet, the holding force being different than zero in an OPEN position and being formed at least partially by a magnet arrangement with at least one permanent magnet, the magnet arrangement being fixed in position in the switching device outside a magnetic circuit formed by the electromagnet and the magnet armature, wherein a resetting force, which acts on the magnet armature, is at a maximum in the OPEN position, and wherein at least one resetting spring, which acts in parallel with the at least one permanent magnet to provide the resetting force, is provided in the magnet arrangement.

2. The electromagnetic switching device as claimed in claim 1, wherein the at least one permanent magnet is arranged on a rear side of the magnet armature, facing away from the electromagnet.

3. The electromagnetic switching device as claimed in claim 2, wherein the at least one permanent magnet, with its pole axis at right angles to the movement direction of the magnet armature, is arranged between two baffles extending at right angles to the pole axis.

4. An electromagnetic switching device, comprising:

an electromagnet; and a movable magnet armature, formed at least partially by a magnet arrangement including at least one resetting spring configured to act with at least one permanent magnet in parallel to provide a resetting force, mounted in the switching device with a holding force which counteracts a closing force exerted by the electromagnet, the closing force being greater than zero in an OPEN position, wherein a magnetic circuit is formed by the electromagnet and the movable magnet armature, and wherein the resetting force on the magnet armature is relatively increased in the OPEN position.

5. The electromagnetic switching device as claimed in claim 4, wherein the at least one permanent magnet is arranged on a rear side of the magnet armature, facing away from the electromagnet.

6. The electromagnetic switching device as claimed in claim 5, wherein the at least one permanent magnet, with its pole axis at right angles to the movement direction of the magnet armature, is arranged between two baffles extending at right angles to the pole axis.

7. The electromagnetic switching device as claimed in claim 1, wherein the resetting spring is between the magnet armature and the electromagnet.

8. The electromagnetic switching device as claimed in claim 4, wherein the resetting spring is between the magnet armature and the electromagnet.

9. The electromagnetic switching device as claimed in claim 1, wherein the permanent magnet has a pole axis in parallel to a direction of movement of the magnet armature.

10. The electromagnetic switching device as claimed in claim 4, wherein the permanent magnet has a pole axis in parallel to a direction of movement of the magnet armature.

* * * * *